United States Patent [19]

Grant, Jr.

[11] Patent Number: 5,020,183

[45] Date of Patent: Jun. 4, 1991

[54] CLEANING APPARATUS FOR A PROCESS VESSEL

[75] Inventor: Louis A. Grant, Jr., Pittsburgh, Pa.

[73] Assignee: Louis A. Grant, Inc., Pittsburgh, Pa.

[21] Appl. No.: 495,383

[22] Filed: Mar. 16, 1990

[51] Int. Cl.[5] ..... F22B 37/48

[52] U.S. Cl. ..... 15/246.5; 15/104.07; 15/104.1 C; 134/167 R

[58] Field of Search ..... 15/56, 104.05, 104.1 C, 15/104.07, 104.09, 246.5; 134/167 R, 168 R; 173/90; 187/20; 266/135

[56] References Cited

U.S. PATENT DOCUMENTS

| | | | |
|---|---|---|---|
| 1,325,638 | 12/1919 | Healey | 15/246.5 |
| 1,569,203 | 1/1926 | Rice et al. | 15/104.09 |
| 3,302,976 | 2/1967 | Grant | 15/104.07 |
| 3,471,888 | 10/1969 | Grant et al. | 15/104.07 |
| 3,679,477 | 7/1972 | Zimmer | 15/246.5 |
| 4,210,976 | 7/1980 | Adelt et al. | 15/246.5 |

FOREIGN PATENT DOCUMENTS

| | | | |
|---|---|---|---|
| 57933 | 9/1967 | German Democratic Rep. | 15/246.5 |
| 514261 | 2/1955 | Italy | 15/104.07 |
| 286900 | 11/1989 | Japan | 15/104.05 |
| 447031 | 3/1968 | Switzerland | 15/246.5 |

*Primary Examiner*—Harvey C. Hornsby
*Assistant Examiner*—Mark Spisich
*Attorney, Agent, or Firm*—Webb, Burden, Ziesenheim & Webb

[57] ABSTRACT

An apparatus and method for cleaning hard deposits from the interior wall of a digester vessel. The apparatus includes a work platform assembled within the interior of the vessel from a plurality of prefabricated frame elements introduced into the vessel through a limited access port formed in the vessel wall. The work platform has an open central region to permit passage around a central shaft and radial paddles vertically disposed within the vessel. The platform is raised and lowered within the vessel by cables attached to motors. The apparatus further includes a ring-shaped guide rail on the work platform and a hydraulically activated impact hammer carried on a support arm assembly. The support arm assembly has one end releasably secured to the central shaft within the vessel and the other end supports a motor-driven roller cluster for travel along the guide rail. The support arm also carries a pivotal and extensible boom assembly for hydraulically moving the impact hammer in several degrees of freedom to permit access to all interior wall areas of the vessel. A flexible conduit or bundle of conduits connects the hammer, the roller cluster motor, and related hydraulics to a remote power source outside of the vessel. After the vessel is cleaned, the apparatus is disassembled within the vessel and removed through the access port.

11 Claims, 3 Drawing Sheets

CLEANING APPARATUS FOR A PROCESS VESSEL

BACKGROUND OF THE INVENTION

The present invention relates generally to cleaning devices and more particularly to apparatus for removing deposits from the interior walls of process vessels such as, for example, digester vessels used in aluminum production.

Typically, such digesters are large, cylindrical vessels having a diameter of about thirteen feet and a height of about fifty-five to seventy feet, or more. A hard, glass-like scale builds up gradually over time on the interior walls of the digester vessel and can reach thicknesses on the order of six inches. Heretofore, the removal of such hard deposits has been extremely labor intensive, dangerous and time consuming due to the physical configuration of the digester vessel and the limitations imposed by manually operated tools and by known scaffolding or like rigging. Limited access to the interior of a typical aluminum process digester vessel also presents problems. Due to the restricted opening afforded by the access manhole formed in the top wall of the vessel, usually about twenty-one inches in diameter, only relatively small, light-duty tools and related rigging of limited physical dimensions and weight can be introduced into the interior of the vessel. Additional limitations on clear or open work space within the vessel interior are also caused by a central shaft and radial paddles which extend vertically along the central axis of the vessel.

The present invention solves many of the problems heretofore encountered in cleaning cylindrical digester or other process vessels of the type discussed above. The present invention provides a cleaning apparatus which greatly reduces the time and expense of cleaning the interior walls of such vessels while concurrently producing a cleaner wall and creating a safer work environment for the laborer than heretofore possible.

The present cleaning apparatus includes a stable, vertically moveable work platform carrying a pivotal and extensible impact tool for accessing essentially all of the interior surface of the vessel. The apparatus of the invention also provides a heavy-duty impact tool which has high power capabilities for removal of very thick and hard deposits which was not possible with prior hand-held tools.

Still further, the cleaning apparatus of the present invention provides a stable construction comprising a plurality of prefabricated structural sections which, in a disassembled state, are of a size to conveniently pass through the restricted access manhole of the vessel for relatively fast and easy assembly once inside the vessel. Once assembled and mounted inside the vessel, the invention provides a moveable work platform for carrying the heavy-duty, powered impact tool with a novel clamping arrangement to provide firm support for the tool and a quick release feature to permit passage around the paddles.

SUMMARY OF THE INVENTION

Briefly stated, the present invention is directed to an apparatus for cleaning hard deposits from the interior of a process vessel of the type having an access manhole and a central vertical shaft carrying radially extending, spaced sets of paddles thereon. The cleaning apparatus includes a work platform constructed of a plurality of prefabricated frame members of a size suitable for passage through the manhole and for quick assembly within the interior of the vessel. In the assembled condition, the work platform has an open interior for clearance around the central shaft and paddles and carries a ring-shaped guide track thereon formed concentric with said open interior. Hoisting cables or ropes are provided to suspend the platform from an upper wall portion of the vessel interior with appropriate reeling motors and controls to permit raising and lowering of the platform within the vessel. An impact tool, preferably a hydraulically-actuated hammer having a reciprocating impact bit, is pivotally and extensibly mounted on the platform by way of a boom and support arm assembly. The support arm has a first end carrying a clamp adapted to be releasably secured to the central shaft of the vessel and a second end carrying a cluster of wheels for travel around the ring-shaped guide track on the platform. The mechanical anchoring provided at the first and second ends of the support arm stabilizes and centers the platform about the central shaft to counteract and absorb the impact generated by the reciprocating hammer. A hydraulic power supply unit is located outside of the vessel and is coupled by a flexible conduit to the impact hammer and related movement control hydraulic cylinders associated with the extensible and pivotal boom. Movement of the relatively heavy hammer is thus achieved in several degrees of freedom to assure proper tool angularity and to provide access to substantially all of the interior surface of the vessel. The releasable clamp carried by the first end of the support arm is adapted to be selectively opened in order to pass around the joints between the paddles and the central shaft as the platform is vertically moved therealong.

These, as well as other features and advantages of the present invention, will become more apparent when reference is made to the detailed specification taken with the accompanying drawings.

DETAILED DESCRIPTION OF THE INVENTION

Figure 1:
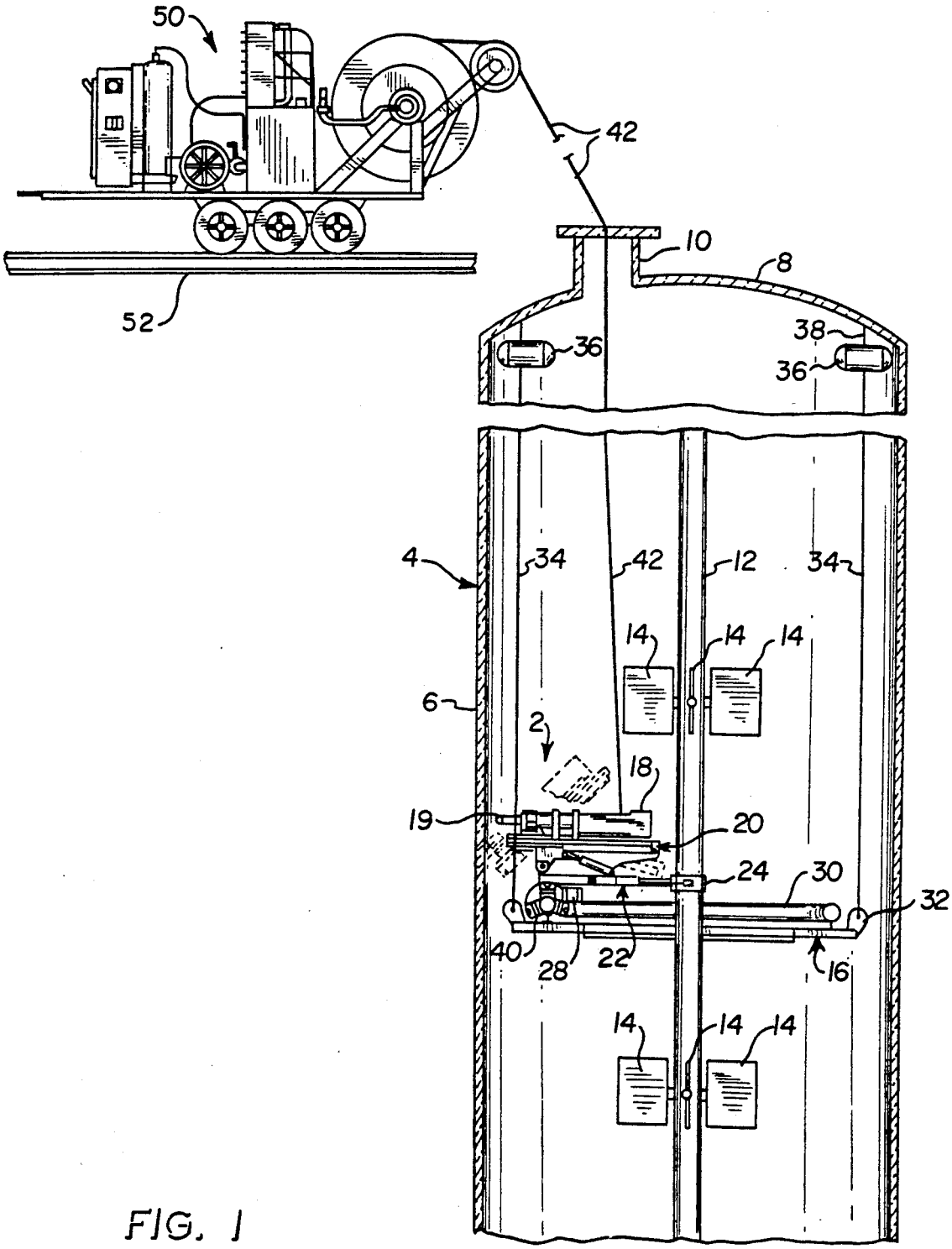
FIG. 1 is a partial side elevation view of the cleaning apparatus of the invention operably positioned within the interior of a digester vessel.

Referring now to the drawings, wherein like elements are identified by like reference numerals throughout, the cleaning apparatus of the invention is designated generally by the reference numeral 2. The cleaning apparatus 2 is particularly suitable for use with process vessels such as digester vessel 4, depicted in FIG. 1. Digester vessel 4 is typical of one type of process vessel used in the production of aluminum and comprises a generally cylindrical, steel-walled body having a sidewall 6, a bottom wall (not shown) and an enclosing top wall 8. Access is gained to the interior of the vessel by way of a manhole having an opening 10 formed in the top wall 8. The typical digester vessel 4 also includes a central, vertical shaft 12 carrying vertically spaced groups of radial paddles 14. The paddles are adapted to stir the contained liquid as the shaft 12 is rotated by a suitable drive mechanism (not shown) when digester vessel is in operation.

As the digestion process continues over time, it has been found that a very hard and brittle, glass-like deposit forms on the interior of the sidewall 6 over the entire vertical height of the wetted area within the vessel. Such hard deposit can reach to thicknesses of about six inches, for example. Considering that a typical digester vessel 4 may have an interior diameter of about thirteen feet and a height of fifty-five to seventy feet, it is readily appreciated that the task of cleaning the hard deposit from the interior wall 6 is formidable. The size limitations imposed by the access manhole 10, which is about 21 inches in diameter, also severely limits the introduction of large powered equipment and/or large rigging into the vessel interior in an effort to make the cleaning task less onerous and safer.

A work platform 16 of the present invention functions as a support area for a workman and for a power-driven impact hammer 18. The platform 16, as shown in FIG. 4, comprises a plurality of prefabricated outer frame members 17. An oppositely disposed pair of prefabricated outer frame members 17 is joined to a pair of center frame channels 21 which, in turn, are joined to a center frame core unit 23. The prefabricated frame members 17, channels 21 and core unit 23 are joined together by bolts and nuts or like fasteners (not shown) to permit easy assembly and disassembly of the platform 16. The frame members, channels and core unit are preferably constructed of high strength, light weight materials such as, for example, aluminum. In the assembled state, the work platform 16 has an open central space 25 defined within the central frame core unit 23. The central space 25 formed in the platform 16 is of a sufficient size to provide radial clearance for the central shaft 12 and the outwardly extending paddles 14 carried thereon, as shown in FIG. 3.

Figure 2:
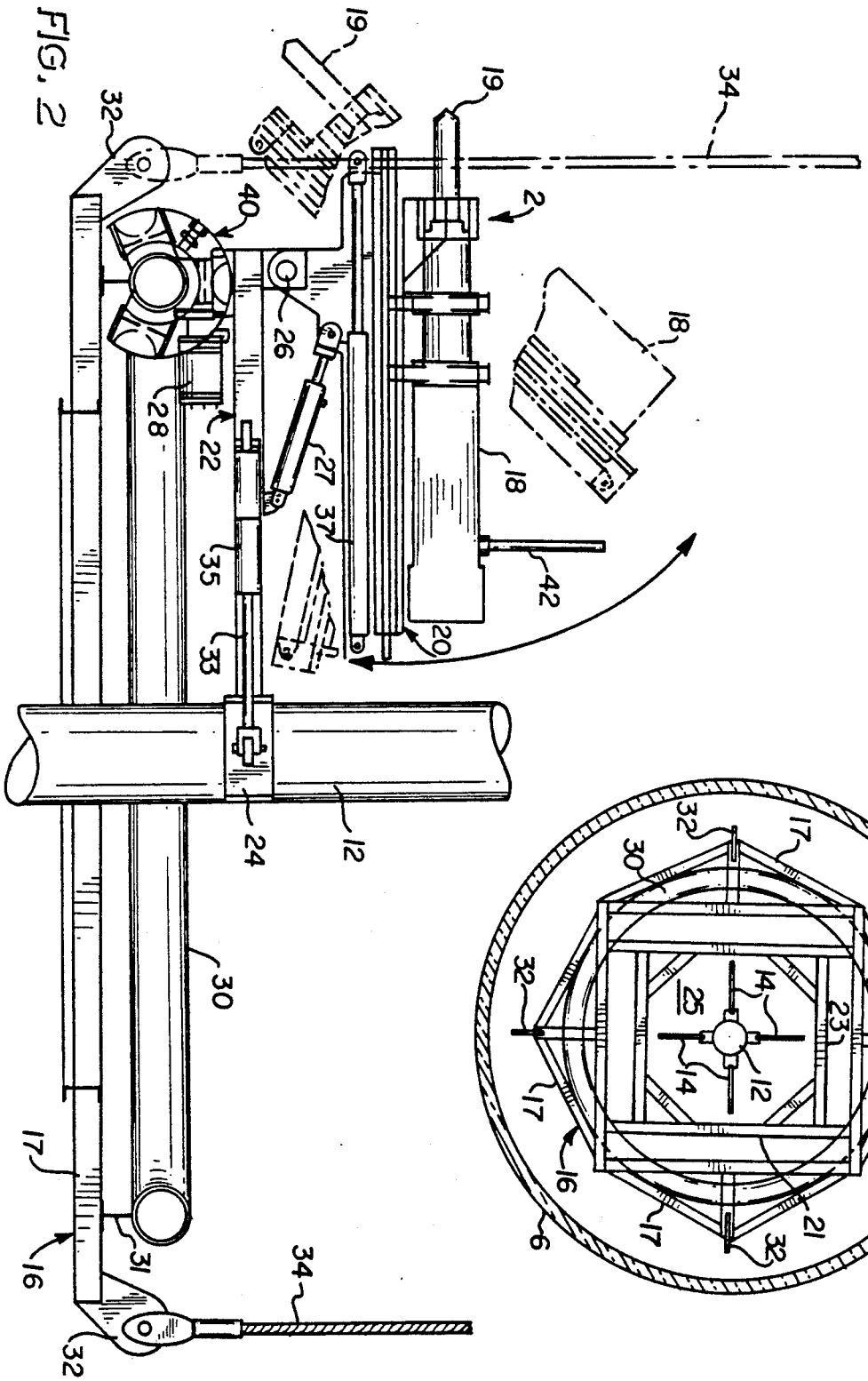
FIG. 2 is an enlarged fragmented view of the cleaning apparatus of FIG. 1, shown in side elevation.
Figure 3:
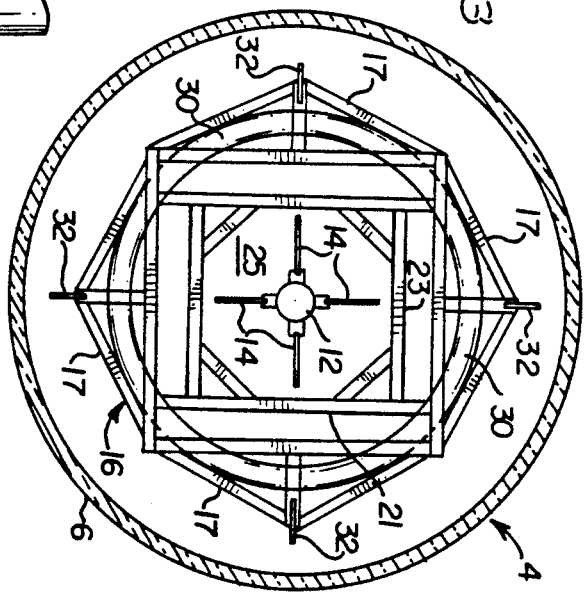
FIG. 3 is a top plan view of the support platform of the present invention positioned within the interior of a process digester vessel.
Figure 4:
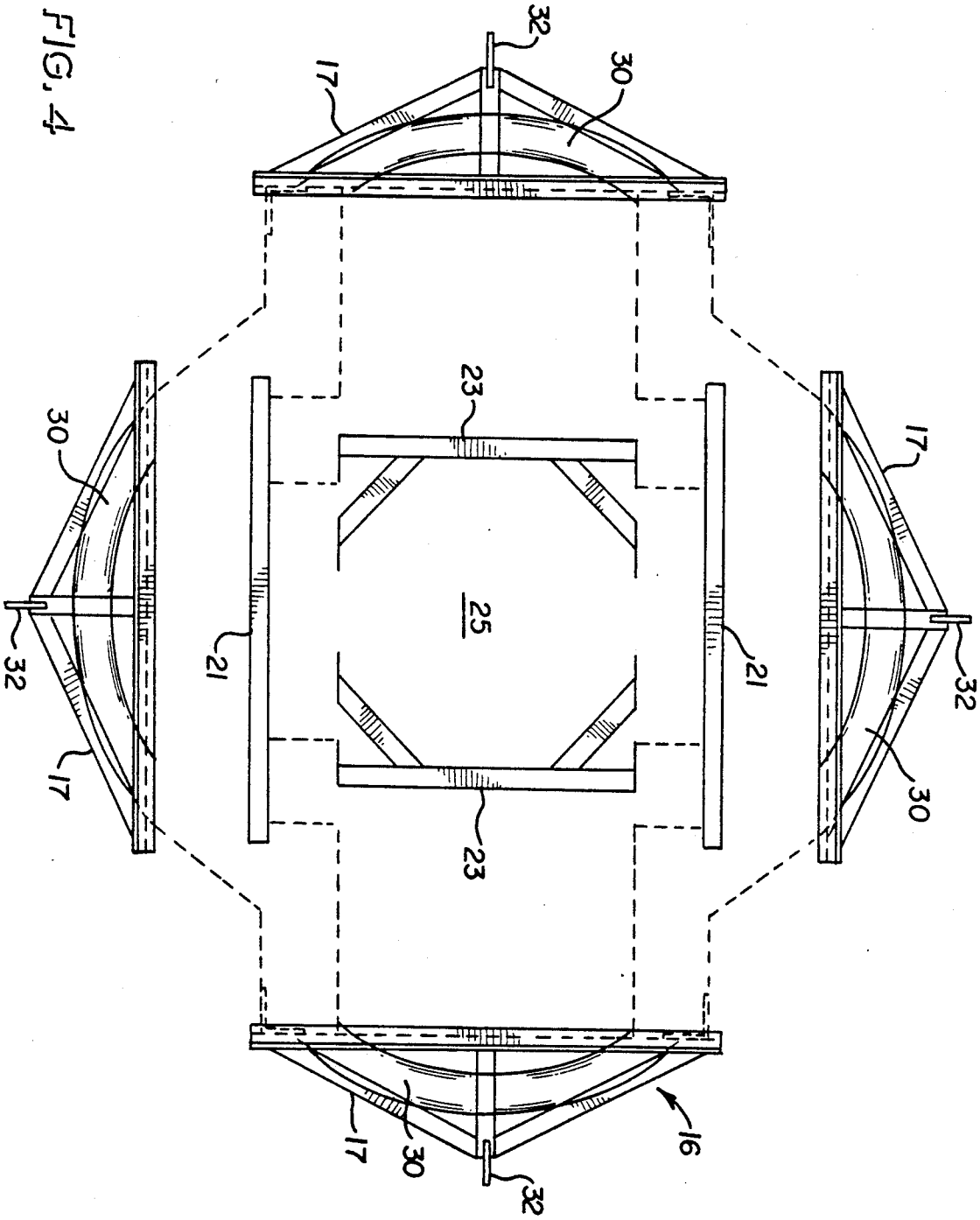
FIG. 4 is a top plan exploded view of the prefabricated component parts which make up the support platform of the invention.

The main frame members 17 of the work platform 16 also carry four lifting webs 32 secured at the four corners thereof, see FIGS. 1 through 3. Each of the lifting webs 32 are clevis pinned to a hoist rope or support cable 34 which, in turn, is connected to a motorized reeling device 36 secured to the top wall 8. The reeling devices are suitably connected to wall 8 by attachment rigging 38. Through well known conventional controls (not shown), the work platform 16 is raised or lowered vertically along the axis of the process vessel 4. The central shaft 12 and paddles 14 freely pass within the clearance provided by the open space 25 as the platform 16 moves vertically within the vessel 4.

The work platform 16 also carries an annular guide rail 30. Guide rail 30 is a tube and is secured to and spaced from the platform 16 by a web 31, see FIG. 2. The guide rail 30 is prefabricated in four 90° segments, as seen in FIG. 4. Each segment is positioned on a main outer frame member 17. When the frame members 17 are joined in the assembled state shown in FIG. 3, the segments connect to form the circular guide rail. The guide rail 30 is adapted to receive a roller cluster assembly 40 whose function and operation will be described in greater detail hereinafter. The web 31 provides the necessary vertical clearance between the roller cluster assembly 40 and the surface of the work platform 16 to insure free unobstructed travel thereon.

The hard deposits formed on the interior walls 6 of the digester vessel 4 are removed by the high-powered hammer 18. Hammer 18 carries a reciprocating bit 19 which is capable of engaging the deposit and the vessel sidewall at an inclined disposition, as shown in the phantom lines of FIG. 2. The hammer 18 is preferably actuated by a hydraulic power source 50 which is located in a remote position, outside of the digester vessel 4. In FIG. 1, hydraulic power source 50 is shown moveably positioned on an existing platform structure mounted on rails 52 commonly found adjacent to a typical digester vessel. The pressurized hydraulic fluid is delivered from the power source 50 by a suitable flexible conduit or bundle of conduits 42 to the hammer 18 and other components to cause the bit 19 to rapidly reciprocate under high pressure in a known manner. Electrical lines may also be included with the conduit 42.

The hammer 18 is moveably carried by a telescoping and tiltable boom support assembly 20. The boom support 20 is carried by a support arm structure 22. The boom support 20 has a generally T-shaped lower section which is pivotally attached by pin 26 through a suitable clevis arrangement to the support arm 22 to permit the boom assembly to tiltably pivot about the pin 26 as indicated by the arrow in FIG. 2 and the phantom figure. This tilting action is motivated by a hydraulic piston and cylinder arrangement 27 which acts between the boom support 20 and the support arm 22. The boom support 20 is constructed of a plurality of nested, telescoping, sliding sections which are extended or retracted by movement of a hydraulic cylinder 37 carried by the boom assembly 20. Thus, the boom assembly 20 can be utilized to clean vessels of varying diameters and is easily extended to access distal points merely by activating the hydraulic cylinders 27 and 37. Hydraulic fluid for activating the cylinders 27 and 37 is also supplied by way of the conduit 42 from the remote hydraulic power source 50.

Still referring to FIG. 2, the support arm 22 which carries the boom 20 and hammer 18 has a first end which carries a releasable clamping mechanism 24 for gripping the central shaft 12. A second end of the support arm 22 carries the aforementioned roller cluster 40 to permit guided movement of the support arm and hammer around the guide rail 30. The guide rail 30 thus provides the impact hammer access to the entire circumference of the inner sidewall 6 of the digester vessel 4. It is observed that the hammer 18 is moveable through three degrees of freedom by way of the guide rail 30, telescoping boom assembly 20 and pivot joint 26 and hoist cables 34.

The roller cluster 40 is made up of three spaced-apart concave rollers which are driven by a motor 28 which is suitably connected thereto through appropriate gearing. The three concave rollers of roller cluster 40 are spaced around the circumference of guide rail 30 such that relative upward movement between the roller cluster and the guide rail is prohibited. In this manner, support arm 22 is stabilized relative to the guide rail 30. As can be seen in FIGS. 1 and 2, the clamp 24 and the roller cluster 40 positioned on the ends of the support arm 22 stabilize and center the work platform 16 about the central shaft 12. In addition, the structure of the support arm 22 provides a stabilized structural foundation for the hammer 18 as it delivers its high powered blows to the hard material being removed. By way of example, a typical hydraulic impact hammer employed in the invention weighs on the order of 320 pounds and delivers about 1200 blows per minute having an impact of 205 foot pounds per blow. It thus can be readily appreciated that the invention permits the use of much heavier and more powerful equipment than heretofore possible with hand-held chipping tools commonly employed in the art.

The movement and activation of the hammer 18 are controlled by an operator who is positioned on the work platform 16. The specific pivotal and extensive movement of the hammer boom is achieved by way of well-known, conventional hydraulic controls (not shown). The operator also controls the movement of the drive motor 28 to cause rotation of the hammer around the circumference of the vessel to insure uniform cleaning thereof. As cleaning proceeds, the hoist rope reeling device 36, which also is controlled by the operator, causes the work platform 16 to move vertically along central .shaft 12. At certain vertically spaced intervals along the central shaft 12, the platform confronts the mixing paddles 14 which block the vertical travel path of the clamp 24. At this juncture, the clamp 24 is opened and disengaged from the shaft 12 by movement of a pair of slide mechanism rods 33. The slide mechanism is motivated by a hydraulically actuated cylinder 35 which causes the two pivotally joined C-shaped segments of the clamp 24 to open and release its grip on the shaft 12. After the clamp 24 has been opened by retraction of the slide mechanism rods 33 and hydraulic cylinder 35, the clamp is moved past the paddle arrangement 14 and re-clamped to the central shaft 12 after the obstruction has been cleared.

After the cleaning work is completed, the work platform 16 is positioned on the bottom of the vessel 4 and disassembled. The structural frame elements 17, 21 and 23 of the platform are then removed from the vessel through the manhole 10. The hammer 18 as well as the support boom and arm are likewise removed by suitable hoisting gear.

In the foregoing specification, I have set out certain preferred practices and embodiments of the invention, however, it will be understood that the invention may be otherwise embodied within the scope of the following claims.

What is claimed is:

1. Apparatus for cleaning hard deposits from an interior sidewall of a vessel having an upper wall and a central shaft vertically extending therein, said apparatus comprising:

a) a work platform for placement within the interior of the vessel, said platform having an open central portion adapted to pass around said central shaft;

b) means adapted to suspend said work platform from the upper wall of the vessel and for vertically moving said platform along said interior sidewall;

c) a ring-shaped guide rail means attached to said work platform;

d) impact tool means for removing said deposits; and e) means supporting said impact tool means, including an elongated support arm assembly having a first end adapted to be attached to said central shaft and a second end carrying roller means for travel about said guide rail means.

2. The apparatus as set forth in claim 1 wherein said means supporting said impact tool means includes a telescoping boom assembly carried by said support arm assembly, said boom assembly including hydraulically actuated means for reciprocating said boom assembly and said impact tool means and means for pivotally mounting said boom assembly to said support arm assembly to permit said boom assembly and said impact tool to pivot in a vertical plane.

3. Apparatus as set forth in claim 1 wherein said guide rail means has a substantially circular cross section and wherein said roller means is a cluster of concave shaped rollers engaging said guide rail means to restrain relative vertical movement therebetween while permitting linear travel movement therealong.

4. The apparatus of claim 3 including a drive motor for moving said cluster of rollers and said support arm assembly along said guide rail means.

5. The apparatus of claim 1 wherein the vessel has an access port of limited dimension formed therein and wherein said work platform comprises a plurality of prefabricated frame elements which, in a disassembled state, are of a physical size capable of passing through said access port and adapted for assembly within the interior of the vessel.

6. The apparatus of claim 1 wherein the vessel has a plurality of spaced radially extending sets of paddles carried by said central shaft, and wherein the first end of said support arm assembly carries a releasable clamp means adapted for selective detachment of said support arm assembly from said central shaft to permit clear passage of said support arm assembly as said work platform is moved past said sets of paddles.

7. The apparatus of claim 1 wherein said impact tool means is a reciprocating, hydraulically actuated hammer and conduit means for coupling said hammer to a remote hydraulic power source.

8. Apparatus for cleaning hard deposits from an interior sidewall of a digester vessel, said vessel having an upper wall with an access port formed therein and a central shaft vertically extending therein with vertically spaced radially extending sets of paddles carried by said central shaft, said cleaning apparatus comprising:

a) a work platform comprising a plurality of prefabricated frame elements adapted for passage through said access port when in a disassembled state and adapted for assembly within said vessel interior, whereby in an assembled state said work platform has an open central portion for passage around said central shaft and said paddles;

b) means adapted to suspend said work platform from the upper wall of the vessel and for vertically moving said platform therein;

c) ring-shaped guide rail means attached to said work platform and adapted to be concentrically spaced from said central shaft;

d) impact tool means for removing said deposits; and e) means supporting said impact tool means including an elongated support arm assembly having a first end carrying clamping means adapted to be releasably attached to the central shaft and a second end carrying roller means for attachment to and travel along said guide rail means, whereby, in use, said support arm assembly is selectively released from said central shaft to permit clear passage as said work platform is moved past said sets of paddles.

9. The apparatus of claim 8 wherein said means supporting said impact tool means includes a telescoping boom assembly carried by said support arm assembly, said boom assembly including hydraulically actuated means for reciprocating said boom assembly and said impact tool means and means for pivotally mounting said boom assembly to said support arm assembly to permit said boom and said impact tool to pivot in a vertical plane.

10. Apparatus as set forth in claim 8 wherein said roller means is a cluster of rollers engaging said guide rail means to restrain relative vertical movement therebetween while permitting linear travel movement therealong.

11. The apparatus of claim 10 including a drive motor means for moving said cluster of rollers and said support arm assembly along said guide rail means.

* * * * *